United States Patent [19]

Sumner

[11] 4,025,662

[45] May 24, 1977

[54] METHOD FOR MAKING ULTRA HIGH RESOLUTION PHOSPHOR SCREENS

[75] Inventor: Barbara E. Sumner, Alexandria, Va.

[73] Assignee: The United States of America as represented by the Secretary of the Army, Washington, D.C.

[22] Filed: Dec. 5, 1974

[21] Appl. No.: 529,875

[52] U.S. Cl. ..... 427/157; 427/64; 427/71; 427/72

[51] Int. Cl.[2] ..... B05B 5/00; D06L 3/12

[58] Field of Search ..... 427/157, 64, 71, 72

[56] References Cited

UNITED STATES PATENTS

| | | | |
|---|---|---|---|
| 2,032,761 | 3/1936 | Marsden | 427/72 |
| 2,344,081 | 3/1944 | Claude | 427/64 |
| 2,527,134 | 10/1950 | Johnson | 427/72 |
| 2,707,687 | 5/1955 | Lockwood et al. | 427/157 |
| 2,757,103 | 7/1956 | Briggs et al. | 427/64 |
| 2,910,376 | 10/1959 | Stankey et al. | 427/72 |
| 3,143,435 | 8/1964 | Martyny | 427/72 |
| 3,313,643 | 4/1967 | Branin | 427/72 |
| 3,533,827 | 10/1970 | Rimbach | 427/73 |
| 3,653,939 | 4/1972 | Prazak | 427/72 |
| 3,689,312 | 9/1972 | Long | 427/64 |
| 3,877,962 | 4/1975 | Taylor et al. | 427/157 |

*Primary Examiner*—Michael R. Lusignan
*Assistant Examiner*—Sadie L. Childs
*Attorney, Agent, or Firm*—Nathan Edelberg; John E. Holford; Robert P. Gibson

[57] ABSTRACT

An ultra high resolution screen is provided by spraying small phosphor particles onto a rotating disc-shaped substrate coated with a thermoplastic film heated to its softening point.

5 Claims, 2 Drawing Figures

METHOD FOR MAKING ULTRA HIGH RESOLUTION PHOSPHOR SCREENS

The invention described herein may be manufactured, used, and licensed by or for the Government for governmental purposes without the payment to me of any royalty thereon.

BACKGROUND OF THE INVENTION

Since phosphor screens are very efficient devices for converting electrical energy to light, these screens are found in an increasing number of devices covering a wide range of applications. Conversion may be direct as in electro luminescent panels or by intermediate radiation processes such ultraviolet ray production in flourescent lights, x-ray production in diagnostic devices or cathode rays in television picture tubes and image intensifiers. Depending upon the application, other properties than efficiency must be considered in choosing a method for fabrication of a particular screen. When cathode ray images are to be focussed on the screen such properties as uniformity, average thickness, texture, color, contrast, secondary emission, and current saturation must be considered. In any case the method should be simple and introduce a minimum of passive material in the final structure.

While all of the above properties are at least partially dependent on the phosphor material employed, they are also dependent on the manner in which the material is deposited. Techniques currently employed involve sedimentation, spraying, brushing, electrophoresis, and photodeposition using various types of polyvinyls. Screens prepared by such techniques are successful in producing numerous commercially available devices, but fall far short of the high resolution and uniformity predicted by the large body of performance data available on such devices. The poor resolution appears to result mainly from the presence of abnormally large particles, agglomenations of small particles, and general variations in the layer thickness.

BRIEF DESCRIPTION OF INVENTION

An object of the invention is to provide a high resolution phosphor screen by utilizing a fabrication procedure which precludes agglomerations of phosphor particles below a given size and rejects particles several times the given size.

A further object is to provide such screens by a fabrication process which is simple, fast and requires only a few readily available materials.

BRIEF DESCRIPTION OF THE DRAWINGS

The invention is best understood with reference to the accompanying drawings wherein.

Figure 1:
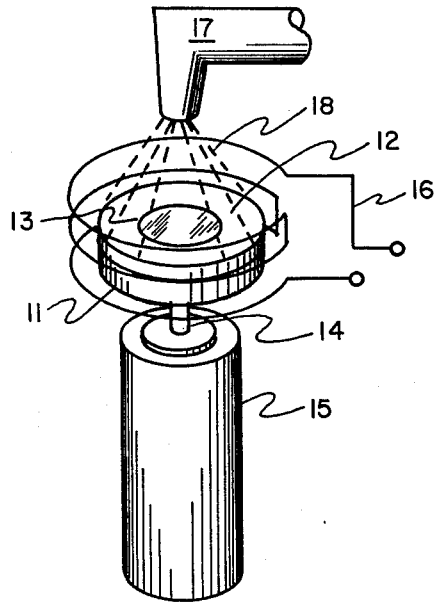
FIG. 1 shows the essential elements of the apparatus for fabricating a phosphor screen according to the present invention.

Referring specifically to FIG. 1, the apparatus used in the fabrication of the phosphor screen is shown. The basic component of the apparatus is a table 11 mounted for rotation about a shaft 14 which may be part of a variable speed electric motor 15 or any other similar source of power. A planar substrate 12 of glass, quartz, sapphire or other translucent material preferably in the form of a flat circular disc, is placed on the table, and if necessary fastened or cemented thereto so that it will not be displaced during rotation. A few drops of a solvent 13, for example toluene, acetone or trichloroethylene are placed in the center of the substrate, the solvent having a thermoplastic material such as ethyl cellulose, nitrocellulose or cellulose acetate dissolved therein. The combination of gravitational centrifugal and surface tension forces acting on the solvent cause it to quickly form a film over the entire surface of the substrate. A heating element 15, preferably electrical, surrounding the table is then activated to accelerate evaporation of the solvent and soften the thermoplastic material, causing the latter to become tacky and bond intimately with the substrate. If desired, automatic temperature sensors and control equipment, not shown, maybe employed to hold the environment at a temperature between the softening point and the melting point of the plastic For the specific plastic materials mentioned above a temperature of 155° C is preferred. A spray gun 17 similar to the type used in spray painting is aimed at the center of the substrate and is spaced therefrom a sufficient distance to encompass the entire substrate in its total angle of spray. The sprayer is charged with nitrogen gas mixed with a commercially available powdered phosphor of the type employed in television picture tubes and image intensifier screens. A preferred sprayer is the Type UT Gun made by the Paasche Manufacturing Company.

Figure 2:
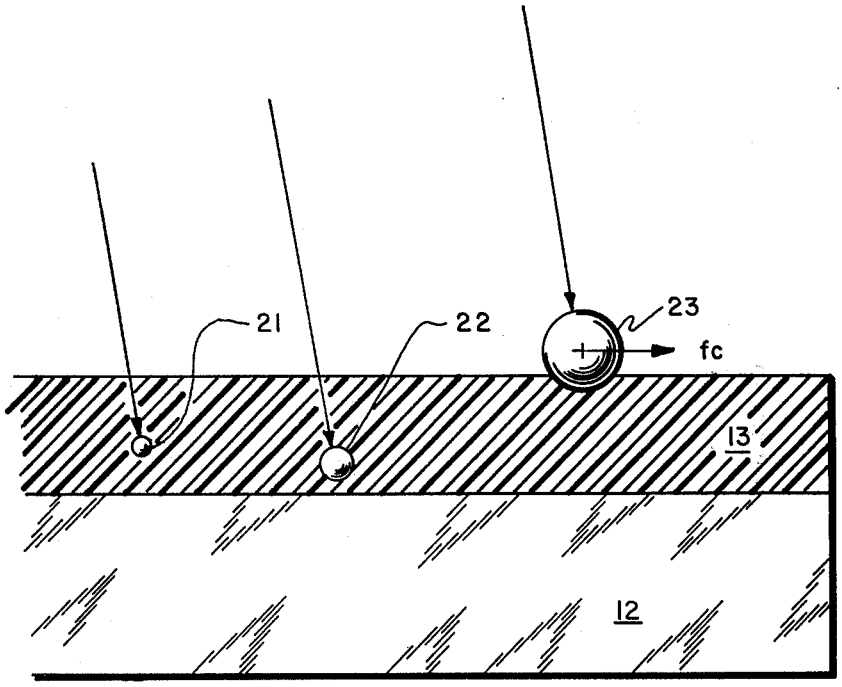
FIG. 2 shows an exaggerated cross-section of the screen to explain some of the phenomena occurring during fabrication.

FIG. 2 shows an exaggerated view of the particles as they appear near the substrate 12. To approach the substrate the particles must overcome the surface tension forces and high viscosity of the softened thermoplastic film. Because of their small size, compared to the film thickness particles 21 and 22 are able to break through the surface tension forces, but their small momentum is quickly dissipated in viscous friction. Somewhat larger particles like 23 because of their shape engage a greater surface area of the film and are stopped by the surface tension and high viscosity without rupturing the surface. These larger particles adhere to the tacky surface of film 13 absorbing its rotational energy until the centrifugal force on it is sufficient to throw it clear of the film. To this end the rotational speed of the film is increased until the outermost edges thereof approach their elastic limit. If a particle has a much greater diameter than the film thickness of it cannot become embedded regardless of its momentum. Phosphor manufacturers supply information on particle populations available so that economy of this material can be maximized. The buildup of particles in the film further reduces the size of particles retained so that the thickness of the particle layer remains thin and becomes more and more uniform. Thus the whole process is very sensitive to the initial thickness of the film 13. This parameter is easily determined by dividing the area of the substrate into the volume of thermoplastic material dissolved in the solvent. A preferred film thickness falls between 0.5 and 1.5 microns. While it is preferred to form the screen on a part of an operational device, such as the faceplate of an image intensifier, it can be formed on an intermediate and even non-translucent substrate and transferred to the faceplate after cooling with or without the substrate. Cooling is permitted after most of the larger particles are displaced from the surface. The action of running water is generally sufficient to remove any particles still clinging to the cooled surface. Light abrasive force can be applied with a lint free cloth as a final finishing step, if desired.

Obviously many variations of the above methods and resulting products will be obvious to those skilled in the art, but the invention is to be limited only as defined in the claims which follow.

I claim:

1. A method of forming an electroluminescent screen on a planar substrate comprising the steps of:

placing a few drops of solvent containing a dissolved thermoplastic material at the center of a broad exposed surface said substrate;

spinning the substrate about an axis normal to said broad surface at a gradually increasing angular velocity until the solvent spreads over the entire area of said broad surface of the substrate;

heating the substrate approximately to the softening temperature of said thermoplastic material;

while spinning and heating increasing said angular velocity until the thermoplastic material at the outermost edges of said substrate approaches its elastic limit;

spraying a mixture of high pressure nitrogen gas and fine phosphor particles of random diameters onto said heat softened thermoplastic material;

cooling said thermoplastic material to room temperature; and flowing water over the surface of said thermoplastic material to remove non-embedded particles adhering thereto.

2. The method according to claim 1 wherein said solvent is toluene and said thermoplastic material is ethyl-cellulose.

3. The method according to claim 1 wherein the diameters of said phosphor particles vary from less than one half micron to several microns.

4. The method according to claim 1 wherein said substrate is heated to 155° Centigrade.

5. The method according to claim 1 wherein said substrate is a flat circular disc.

* * * * *